US005184717A

United States Patent [19]

Chou et al.

[11] Patent Number: 5,184,717

[45] Date of Patent: Feb. 9, 1993

[54] CIRCUIT BREAKER WITH WELDED CONTACTS

[75] Inventors: Yu W. Chou, Coraopolis; Henry K. Pruszynski, Wilkinsburg, both of Pa.

[73] Assignee: Westinghouse Electric Corp., Pittsburgh, Pa.

[21] Appl. No.: 706,714

[22] Filed: May 29, 1991

[51] Int. Cl.[5] ..... H01H 5/23

[52] U.S. Cl. ..... 200/401; 200/327; 200/DIG. 42; 335/24; 335/166; 335/168

[58] Field of Search ..... 200/401, 318, 323, 324, 200/325, 326, 327, 43.16, DIG. 42; 337/47, 48, 49, 50, 70; 335/166, 167, 168, 169, 170, 171, 172, 173, 174, 175, 9, 10, 22, 23, 24

[56] References Cited

U.S. PATENT DOCUMENTS

| | | | |
|---|---|---|---|
| 3,525,959 | 7/1970 | Ellsworth et al. | 335/166 |
| 3,614,685 | 10/1971 | Ellsworth et al. | 335/166 |
| 3,849,747 | 11/1974 | Mrenna et al. | 335/166 |
| 4,546,224 | 10/1985 | Mostosi | 200/401 |
| 4,630,019 | 12/1986 | Maier et al. | 337/70 |
| 4,679,016 | 7/1987 | Ciarcia et al. | 335/9 |
| 4,713,639 | 12/1987 | Grunert et al. | 335/175 X |

*Primary Examiner*—Henry J. Recla
*Assistant Examiner*—Glenn T. Barrett
*Attorney, Agent, or Firm*—M. J. Moran

[57] ABSTRACT

The handle of a circuit breaker is blocked from movement to the off positiion, when the contacts are welded closed, thereby preventing rotation of the common cross-bar on which contact arms carrying the movable contacts are mounted, by an interlock which includes radial extensions on the arms of a pivoted handle yoke which radially engage projections on the cross-bar.

7 Claims, 6 Drawing Sheets

CIRCUIT BREAKER WITH WELDED CONTACTS

CROSS REFERENCE TO RELATED APPLICATIONS

Commonly owned, U.S. Patent Application entitled "Circuit Breaker with Interlock for Welded Contacts" filed concurrently herewith on May 29, 1991 in the names of Charles W. Pipich and William E. Beatty and is identified by application Ser. No. 706,720.

Commonly owned, U.S. Patent Application entitled "Circuit Breaker with Positive On/Off Interlock" filed concurrently herewith on May 29, 1991 in the names of Henry R. Beck and Charles W. Pipich and is identified by application Ser. No. 706,714.

Commonly owned, U.S. patent application Ser. No. 503,812 entitled "Circuit Breaker Positive Interlock" filed Apr. 3, 1990 by D. A. Parks, T. A. Whitaker, and Y. W. Chou.

BACKGROUND OF THE INVENTION

1. Field of the Invention

This invention relates to a circuit breaker in which the handle is blocked from movement to the off position when the contacts are welded closed.

2. Background Information

A common type of circuit breaker has a fixed electrical contact, and a movable electrical contact mounted on a movable contact arm. The contacts are closed and opened by rotating a handle between an on and off position, respectively. A latchable cradle connected to the movable contact arm by a spring operated toggle device is held in a latched position by a trip device. In response to predetermined overload conditions in the circuit breaker, the trip mechanism unlatches the latchable cradle and the spring operated toggle device rotates the movable contact arm to open the contacts. When the circuit breaker is tripped in this manner, the spring operated toggle device also moves the handle to a trip position intermediate the on and off positions. Thus, the handle provides a visual indication of the state of the circuit breaker. The circuit breaker is reset by moving the handle slightly past the off position to relatch the latchable cradle, and then to the on position to reclose the contacts.

It is possible under some overload conditions for the contacts of a circuit breaker to become welded closed. Under these circumstances, the trip device of the circuit breaker described above can respond to the overload condition by unlatching the latchable cradle. If the weld is of sufficient strength, the contact arm cannot be rotated and the contacts remain closed. However, it is possible to rotate the handle to the off position to relatch the cradle.

Several remedies for this condition have been proposed. In U.S. Pat. No. 3,525,959, the cradle is latched by a latch member which is engaged by the trip mechanism. To reset a tripped circuit breaker of this type, the knee pivot of the toggle which forms part of a spring loaded operating mechanism which trips the breaker, engages the latch member as the handle is moved to the off position to relatch the cradle. When the breaker is tripped, but the contacts are welded closed, the toggle remains erected and does not engage the latch member to relatch the cradle when the handle is moved to the off position. Thus, the cradle cannot be reset and the springs of the actuating mechanism maintain the handle in the on position when released indicating the true condition of the contacts.

In one embodiment of the circuit breaker of U.S. Pat. No. 3,614,685, a blocking member on the movable contact arm structure prevents the cradle from moving to a position at which it can be relatched by the trip mechanism when the handle is moved to the off position following a trip with the contacts welded closed In another embodiment of this circuit breaker, a latch on the cradle engages a stationary part to prevent rotation of the cradle to the relatched position following a trip with the contacts welded closed. In both embodiments, the springs bias the handle to the on position under these conditions to indicate the real position of the welded contacts.

In U.S. Pat. No. 4,630,019, a handle yoke latch prevents rotation of the handle to the reset position if the contacts are welded closed. When the contacts are not welded closed, the movable contact arm structure rotates the handle yoke latch out of the path of the handle yoke to permit a tripped circuit breaker to be reset.

While the circuit breakers in U.S. Pat. Nos. 3,525,959 and 3,614,685 prevent relatching of the cradle following a trip with the contacts welded closed, and bias the handle to the on position to show that the contacts remain closed, the handle can still be moved to the off position. In some applications, circuit breakers are operated remotely by a motor operator. If the handle can be moved to the off position even though biased to the on position, the motor operator could hold the handle in the off position providing an indication that the contacts of the circuit breaker were open when in fact they were welded closed. In addition, in some installations, the circuit breaker is mounted in a cabinet with the handle mechanism extending through the cabinet door wall for external operation. It is possible for such a handle mechanism to have sufficient friction that the handle could remain in the off position despite the spring bias in the circuit breaker to the open position when the contacts were welded closed. In some installations, a hasp lock is provided to lock the circuit breaker in the off position. If the handle can be moved to the off position with the contacts welded closed, it is possible for the handle to be locked in the off position when in fact the contacts are welded closed. Obviously, this is not a satisfactory condition.

U.S. Pat. No. 3,849,747 discloses a miniature circuit breaker with a latchable cradle which is connected by a spring to a movable contact arm which in turn is connected to a handle. Since the handle is connected directly to the contact arm, it cannot be moved to the off position if the contacts are welded closed, and correspondingly, the handle cannot be relatched.

Commonly owned U.S. patent application Ser. No. 07/511,700, entitled "Circuit Breaker with Positive Indication of Welded Contacts" and filed on Apr. 20, 1990 discloses a circuit breaker in which an interference device in the form of a pin on a cross-bar joining the movable contact arm associated with each phase of the circuit breaker engages the operating member incorporating the handle to prevent rotation of the handle to the off position when the contacts are welded closed.

It is the primary object of the present invention to provide a circuit breaker with an improved arrangement for preventing movement of the operating handle to the off position when the contacts are welded closed.

SUMMARY OF THE INVENTION

This and other objects are realized by the invention which is directed to an electrical circuit breaker having a fixed contact, and a movable contact carried by a movable contact arm structure. A spring powered operating mechanism, which includes a pivoted operating member carrying a handle, rotates the movable contact arm structure between an on position of the handle in which the movable contact arm structure is in a closed position to close the contacts, and an off position of the handle in which the movable contact arm structure is in an open position to open the contacts. A trip device actuates the spring powered operating mechanism to rotate the movable contact arm structure to the open position and place the handle in a tripped position between the on and off positions in response to predetermined current overload conditions. The circuit breaker is provided with an interlock which includes a radially extending projection on the movable contact arm structure having a generally radially outward facing abutment surface, and a generally radially facing engagement surface on the pivoted operating member. The engagement surface on the pivoted operating member engages the abutment surface on the movable contact arm structure to prevent movement of the handle to the off position when the movable contact arm structure is prevented from rotating with the contacts welded closed. When the contacts are not welded closed, movement of the handle toward the off position rotates the contact arm structure and therefore the projection thereon out of the path of the engagement surface on the pivoted operating member permitting normal operation of the circuit breaker.

More particularly, the movable contact arm structure includes a cross-bar mounted for rotation about a longitudinal axis and on which are mounted contact arms carrying the movable contacts. The projection forming part of the interlock extends generally radially outward from the cross-bar. This projection may be integrally molded with the molded cross-bar or may take the form of an insert seated in a recess in the cross-bar. In the preferred embodiment of the invention, the pivoted operating member includes a handle yoke having a pair of arms pivoted for movement about free ends, and the engagement surface is provided on extensions on the yoke arms. A pair of projections are provided on the cross-bar with each projection aligned with one of the extensions on the handle yoke.

Preferably, the abutment surfaces on the projections are curved about a center which is coaxial with the longitudinal axis of the cross-bar. With the curved abutment surface, rotation of the handle is arrested at a fixed position despite relative rotation between the contact arm of a welded contact and a cross-bar due to contact loading springs in the cross-bar.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENTS

The drawings show a new and improved circuit breaker 1 incorporating the invention. The circuit breaker 1 is of the type described in U.S. Pat. No. 4,630,019 which is hereby incorporated by reference for providing full details of the basic circuit breaker.

While the invention is shown as applied to a three phase circuit breaker, it will be evident to those skilled in the art that the invention has equal applicability to single phase or other multiphase circuit breakers, including three-phase circuit breakers with a neutral line.

Figure 1:
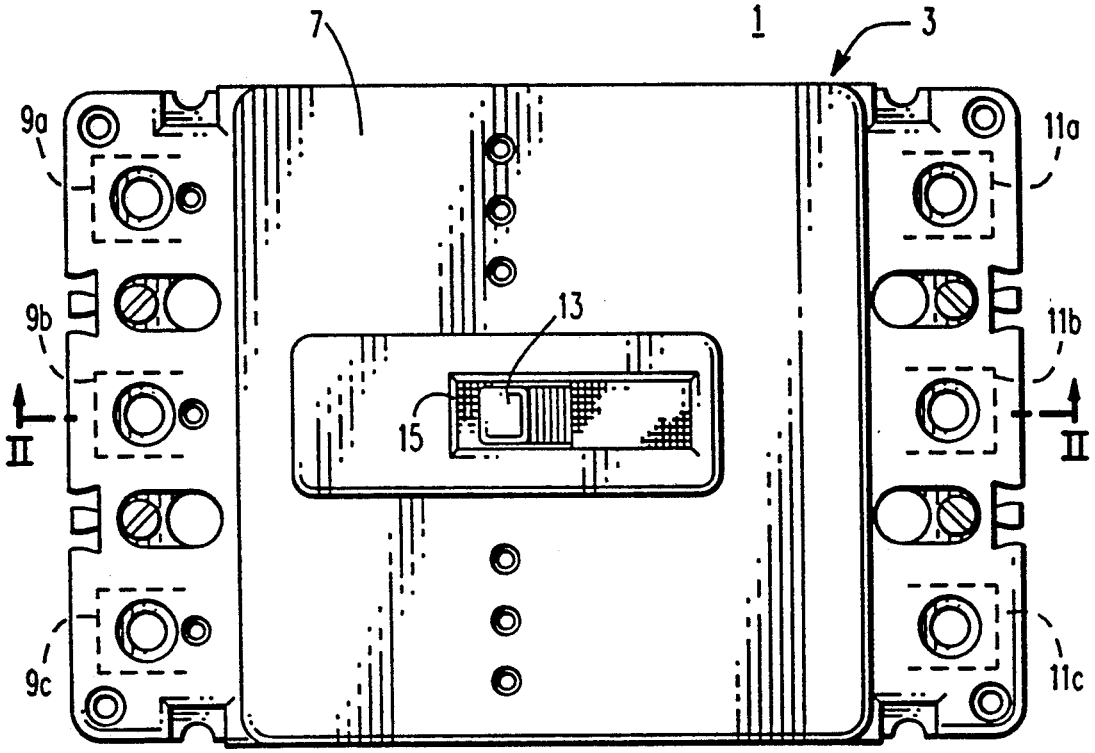
FIG. 1 is a plan view of a circuit breaker incorporating the invention.

As shown in FIG. 1, the circuit breaker 1 includes a molded, electrically insulating enclosure 3 comprising a base 5 (see FIG. 2) and a removable cover 7. A set of input terminals 9*a*, 9*b* and 9*c*, one for each pole, and a set of output terminals 11*a*, 11*b* and 11*c*, are provided to connect the circuit breaker 1 into, in this instance, a three phase electrical system to be protected by the circuit breaker. A handle 13 for manually opening and closing the circuit breaker, and for indicating the state of circuit breaker extends through an opening 15 in the cover 7.

Figure 2:
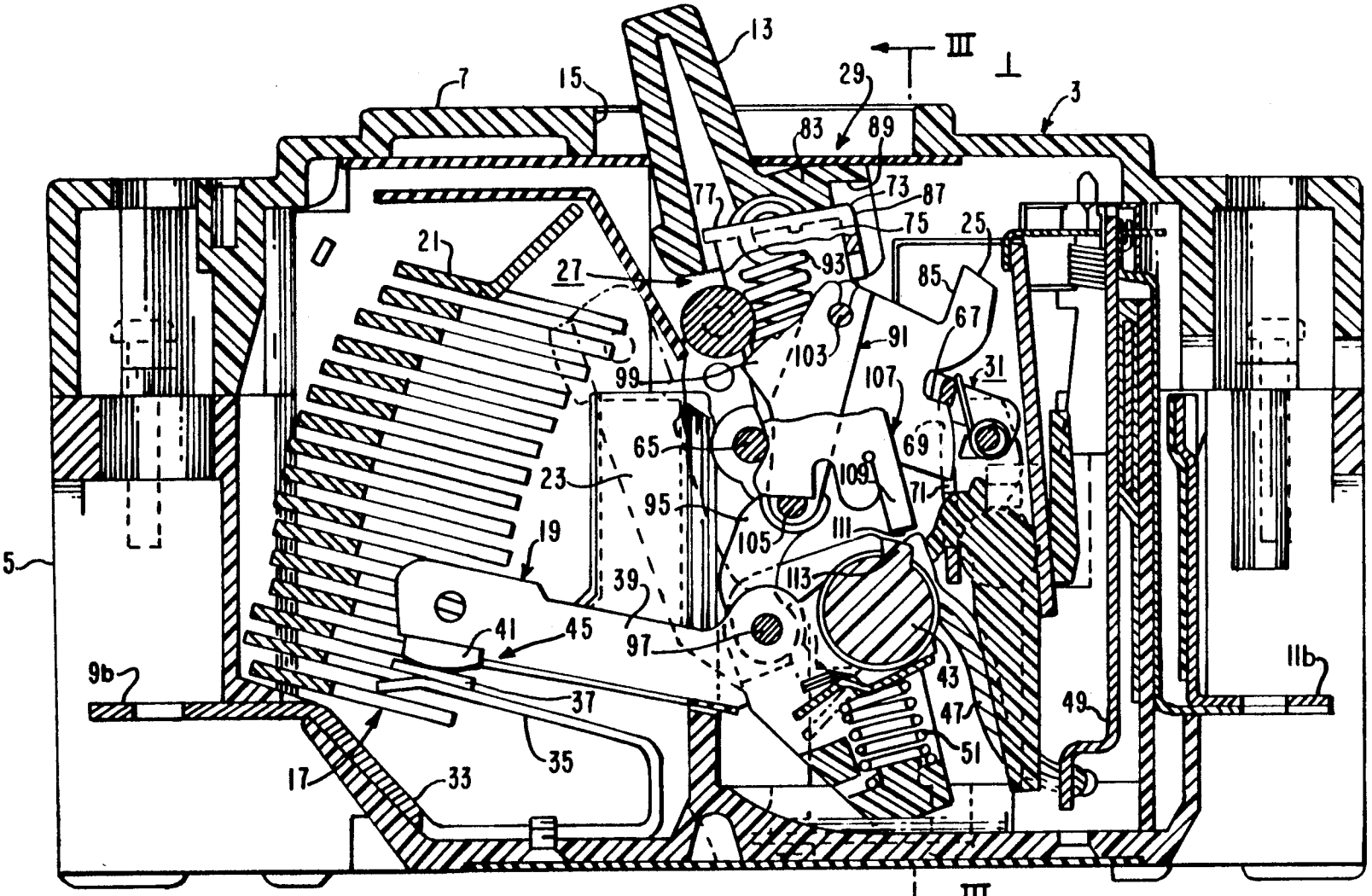
FIG. 2 is a longitudinal vertical section taken along the line II—II of the circuit breaker of FIG. 1 shown in the on or closed position with some parts broken away.

Turning to FIG. 2, which is a cross section through the center pole with some parts broken away, circuit breaker 1 includes for each pole a lower contact structure 17, a movable contact structure 19, an arc chute 21 to aid in extinguishing the electrical arc created by the interrupting current through the pole, and a slot motor 23 to aid in accelerating interruption of the current. The major components of the circuit breaker 1 also include a common latchable cradle 25, a spring operated actuating mechanism 27, an operating member 29 and a trip mechanism 31 which is responsive to predetermined overcurrent conditions in each pole.

The lower contact structure 17 includes a stationary conducting member 33, the outer end of which constitutes the input terminal 9 for the respective pole. The stationary conducting member 33 has a cantilevered inner end 35 which carries a fixed electrical contact 37.

The movable contact structure 19 includes a movable contact arm 39 carrying at its outer end a movable electrical contact 41. Each of the movable contact arms 39 is mounted on a common transverse cross-bar 43 for simultaneous rotational movement between a closed position shown in FIG. 2 and an open position shown in FIG. 4. The fixed electrical contact 37 and the movable electrical contact 41 form a set of contacts 45 which are closed to complete an electrical circuit through the circuit breaker when the contact arm is in the closed position, and to interrupt current through the respective pole of the circuit breaker when the contact arm is in the open position. A flexible conductor 47 is connected between the movable contact arm 39 and a bimetal 49 which in turn is connected to the respective output terminal 11.

The movable contact arms 39 for the three poles are pivotally connected to the common cross-bar 43 and are biased by compression springs 51 mounted in recesses within the cross-bar. These compression springs 51 insure that the movable contact arms 39 move in unison with the cross-bar 43 and apply a predetermined closing force to the set of contacts 45. They also permit the electrical contacts 45 to rapidly separate when blown open by a high level short circuit without waiting for the operating mechanism to sequence.

Figure 3:
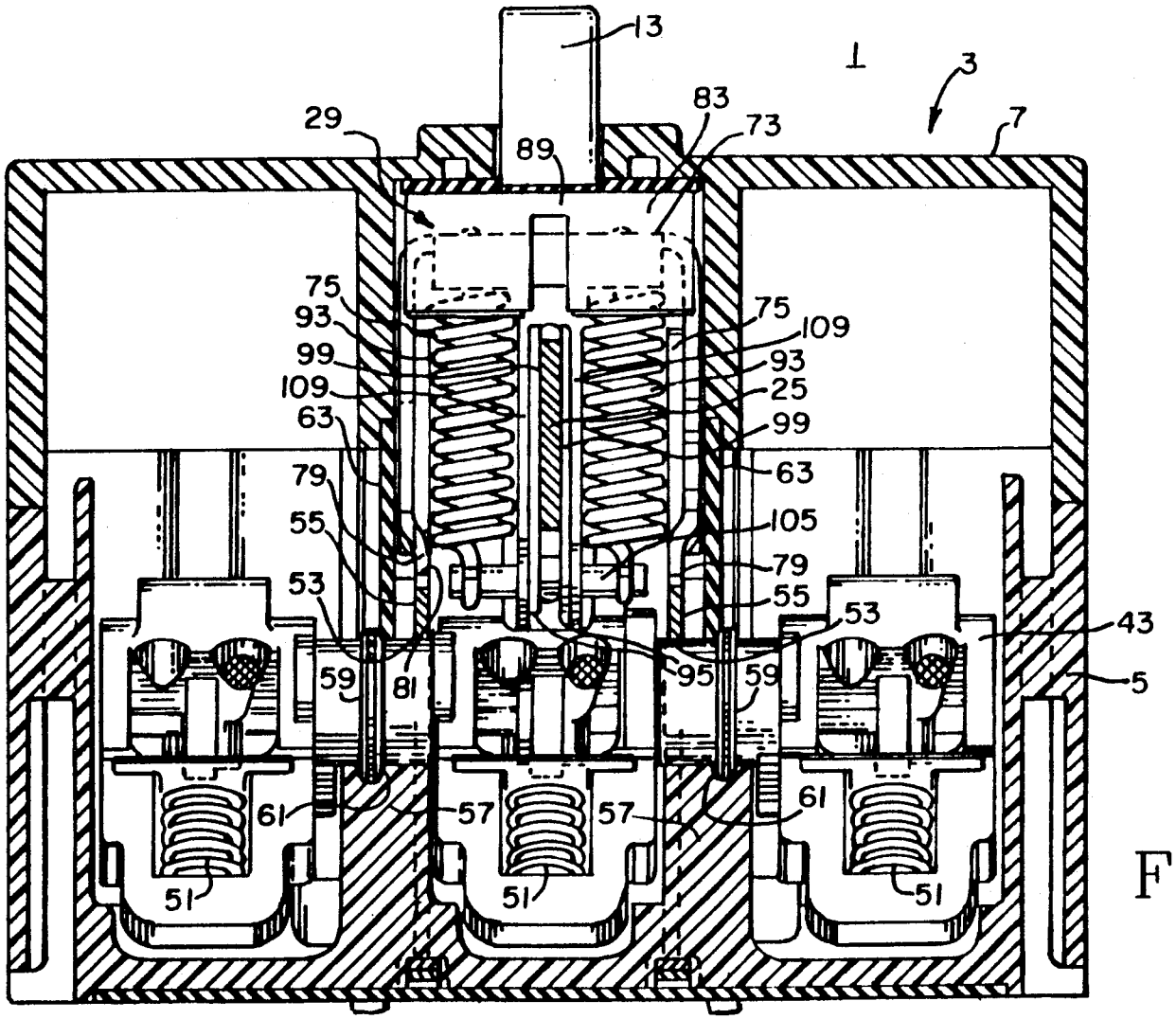
FIG. 3 is a transverse vertical section of the circuit breaker of FIG. 2 taken generally along the line III—III.

As best seen in FIG. 3, the common cross-bar 43 is journaled for rotation in apertures 53 in spaced apart side plates 55 secured in partitions 57 in the molded base 5 of the circuit breaker. Axial movement of the cross-bar is restrained by integral flanges 59 which are engaged by grooves 61 in the partitions 57. Insulating panels 63 electrically isolate the poles of the circuit breaker 1.

Referring again to FIG. 2, the latchable cradle 25 is mounted for rotation about one end by a cradle pin 65 supported by the side plates 55. The free end of the latchable cradle includes a slot or groove defining a latching surface 67. This latching surface 67 engages a slot 69 in a latch plate 71 which forms part of the trip mechanism 31.

The operating member 29 includes a U-shaped yoke 73 having a pair of spaced apart parallel arms 75 (shown broken partly away in FIG. 2) joined by a web 77. As is best seen in FIG. 3, arcuate free ends of tabs 79 inwardly offset from the lower ends of the operating member arms 75 are received in and rotate in arcuate recesses 81 in the side plates 55. The operating member 29 includes the handle 13 having an integrally molded base 83 which is secured to the yoke 73. The handle 13, and with it the yoke 73, are movable between the on position shown in FIG. 2 and a reset position shown in FIG. 4 which is slightly past the off position. They are also positionable to a trip position shown in FIG. 5 which is intermediate the on and off positions. The cradle 25 includes a yoke contacting surface 85 configured to contact a flange 87 on the web 77 through a slot 89 in the molded base 83 on the handle 13. (See FIGS. 2 and 3.) The contact surface 85 on the cradle 25 contacts the flange 87 to position the handle to the tripped position when the trip mechanism releases the cradle. When the handle 13 is moved past the off position, the flange 87 contacts the surface 85 to rotate the cradle 25 for relatching.

The spring operated actuating mechanism 27 includes a toggle device 91 and a pair of helical tension springs 93. The toggle device 91 includes a pair of lower toggle arms 95 straddling the movable contact arm 39 of the center pole and pivotally connected thereto by a lower toggle pin 97. The toggle device 91 further includes a pair of upper toggle arms 99 straddling the latchable cradle 25 and having an upper toggle pin 103 extending through and connected to the cradle 25. The upper and lower pairs of toggle arms 99 and 95 are pivotally connected together by a toggle knee pin 105. The pair of helical tension springs 93 are stretched between the web 77 of the yoke 73 and the toggle knee pin 105 outside the upper toggle arms 99.

With the handle 13 in the on position, the line of action of the springs 93 is to the left of the upper toggle pin 103, as viewed in FIG. 2, to rotate the toggle knee pin 105 in the clockwise direction relative to the pin 103. With the latching cradle 25 engaged by the intermediate latch plate 71, the lower toggle arms 95 are rotated in a counterclockwise direction relative to pin 97 to rotate the cross-bar 43, and therefore, each of the movable contact arms 39, in the counterclockwise direction to the closed position wherein the electrical contacts 45 are closed.

Upon the occurrence of predetermined overcurrent conditions in one of the poles of the circuit breaker 1, the trip device 31 (such as the device described in detail in U.S. Pat. No. 4,630,019) is operated to rotate the latching plate 71 out of engagement with the latching surface 67 on the latchable cradle 25. With the cradle 25 unlatched, the springs 93 acting through the toggle knee pin 105, upper toggle arms 99 and upper toggle pin 103, rapidly accelerate the latchable cradle 25 in the counterclockwise direction as viewed in FIG. 2. This shifts the line of action of the tension springs 93 behind the toggle pin 103 causing the toggle mechanism to collapse, thereby raising the toggle knee pin 105, and through the lower toggle arms 95, the lower toggle pin 97. Raising of the lower toggle pin 97 rotates the cross-bar 43 in the clockwise direction thereby raising all of the movable contact arms 39 to simultaneously open the sets of contacts 45 for each pole of the circuit breaker. As this occurs, any electrical arc struck across the sets of contacts 45 are extinguished by the arc chutes 21. As the toggle device 91 breaks, with the upper toggle arms 99 rotating counterclockwise and the lower toggle arms 95 rotating clockwise, the yoke 73 carrying the handle 13 is moved to the intermediate position shown in FIG. 5 by the rotating cradle 25 which contacts the flange 87 on the yoke. This positioning of the handle between the off and on positions provides a visual indication that the circuit breaker 1 has tripped.

Figure 4:
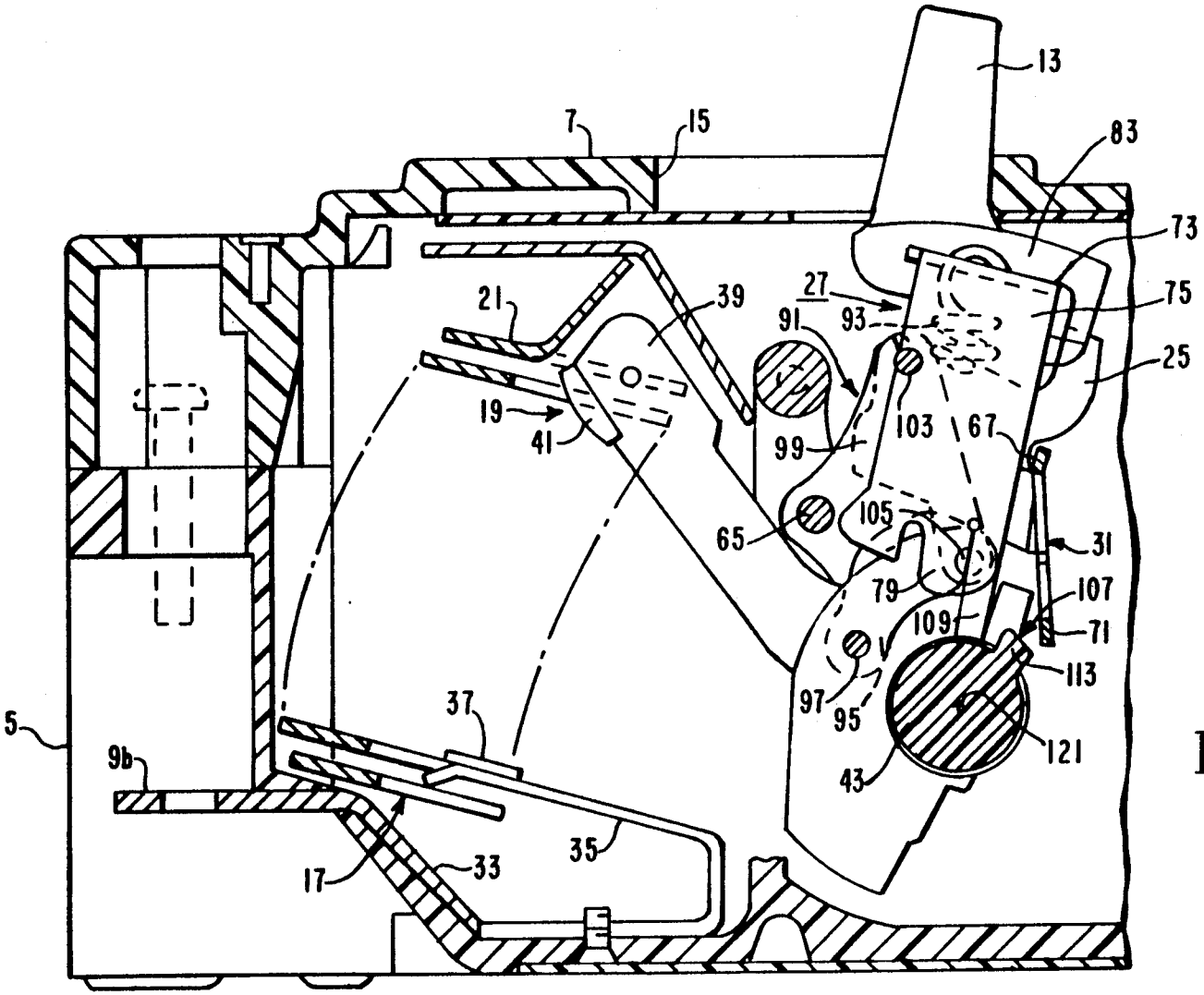
FIG. 4 is a fragmentary view similar to the view of FIG. 2 showing the circuit breaker in the reset position which is slightly past the normal open or off position.

To reset the circuit breaker the handle 13 is moved toward, and slightly past the off, or full clockwise position, as viewed in FIG. 4. As the handle is brought to this reset position, the flange 87 on the yoke 73 bears against the surface 85 on the latchable cradle 25 to rotate the cradle clockwise until the latching surface 67 engages the intermediate latch plate 71 of the trip mechanism 31. Movement of the handle to this position causes the line of action of the springs 93 to move to the right of the toggle pin 103 so that the handle remains in the off position.

To again close the circuit breaker, the handle 13 is moved from the off position shown in FIG. 4 to the on position shown in FIG. 2. When the line of action of the springs 93 passes to the left of the upper toggle pin 105, the toggle device 91 is erected and the cross-bar 43 is rotated counterclockwise to close the sets of electrical contacts 45 as previously described.

If the set of contacts 45 of any one of the poles of the circuit breaker 1 is welded closed, the associated contact arm 39, and therefore, the cross-bar 43 and the other movable contact arms 39, cannot be rotated. Thus, the contacts 45 for all of the poles remain closed. In the case of a trip, even though the latchable cradle 25 is released by the latch plate 71, the handle 13 remains in the on position because the toggle knee pin 105 is prevented from rising by the welded contacts, and hence, the toggle device remains erected. Without the present invention, however, it would still be possible to move the handle 13 to the off position although it would spring back to the on position when released since the line of action of the springs 93 could not be moved to the right of the upper toggle pin 105. As previously mentioned, however, this is not a satisfactory condition where the handle 13 is operated remotely by a motor driven operator or by a handle extension when a circuit breaker is mounted within an enclosure, or when the possibility of locking the handle in the off position using a hasp lock exists.

Figure 6:
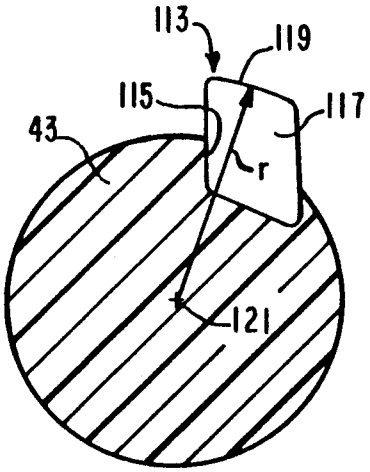
FIG. 6 is an enlargement of a portion of the vertical section shown in FIG. 2.

In accordance with the invention, an interlock 107 is provided to prevent rotation of the handle 13 to the off position when the contacts 45 are welded closed. The interlock 107 includes longitudinal extensions 109 on the arms 75 of the yoke 73. The extensions 109 extend in the plane of the arm 75 and are thus outside of the side plates 55 as can be seen in FIG. 3. These extensions 109 terminate in radial engagement surfaces 111. The interlock 107 also includes radially outwardly by extending projections 113 on the cross-bar 43. These projections 113 can be integrally molded with the cross-bar 43. Preferably, however, as seen in the enlarged view of FIG. 6, radial recesses 115 are molded in the cross-bar 43, and the projections 113 are formed by inserts 117 seated in the recesses 115. In this manner, the inserts 117 can be made from a different material than the resin of the molded cross-bar 43. For instance, the inserts 117 can be made of metal for metal-to-metal contact with the extensions 109 on the yoke 73. The projections 113 such as the inserts 117 terminate in radially outward facing abutment surfaces 119. These surfaces 119 form a sector of a circle of radius r centered on the longitudinal axis 121 of the cross-bar 43.

As seen in FIG. 3, the projections 113 are axially aligned on the cross-bar 43 to be in the same plane as the extensions 109 on the arms 75 of the yoke 73. When the contacts 45 are closed, the cross-bar is positioned so that the projections 113 extend upward toward the extensions 109 on the yoke arms 75. However, with the handle in the on position, the yoke 73 is rotated so that there is clearance between the extensions 109 and the projection 113 on the cross-bar.

Figure 5:
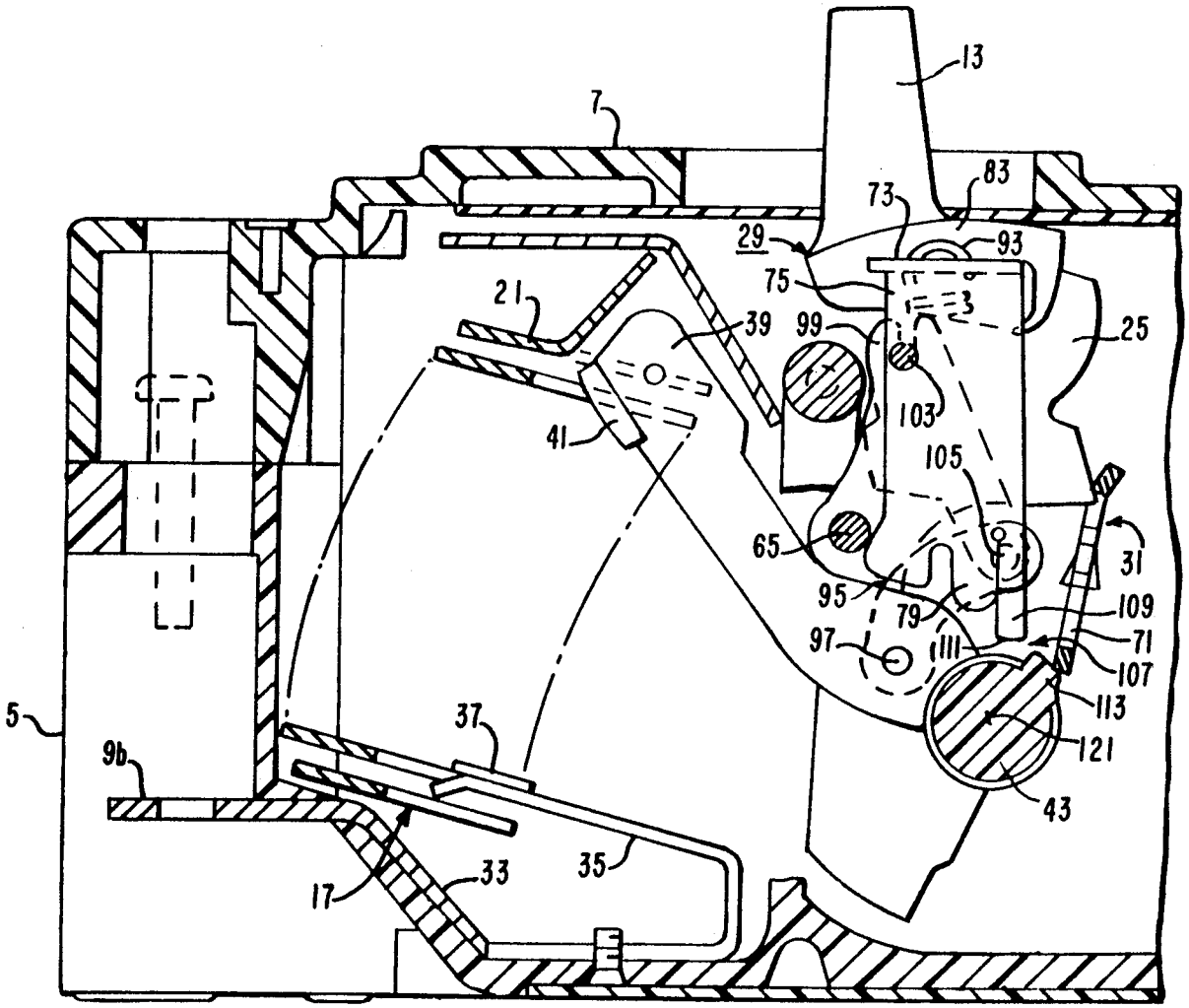
FIG. 5 is a fragmentary view similar to FIG. 2 showing the circuit breaker in the normal trip position.
Figure 7:
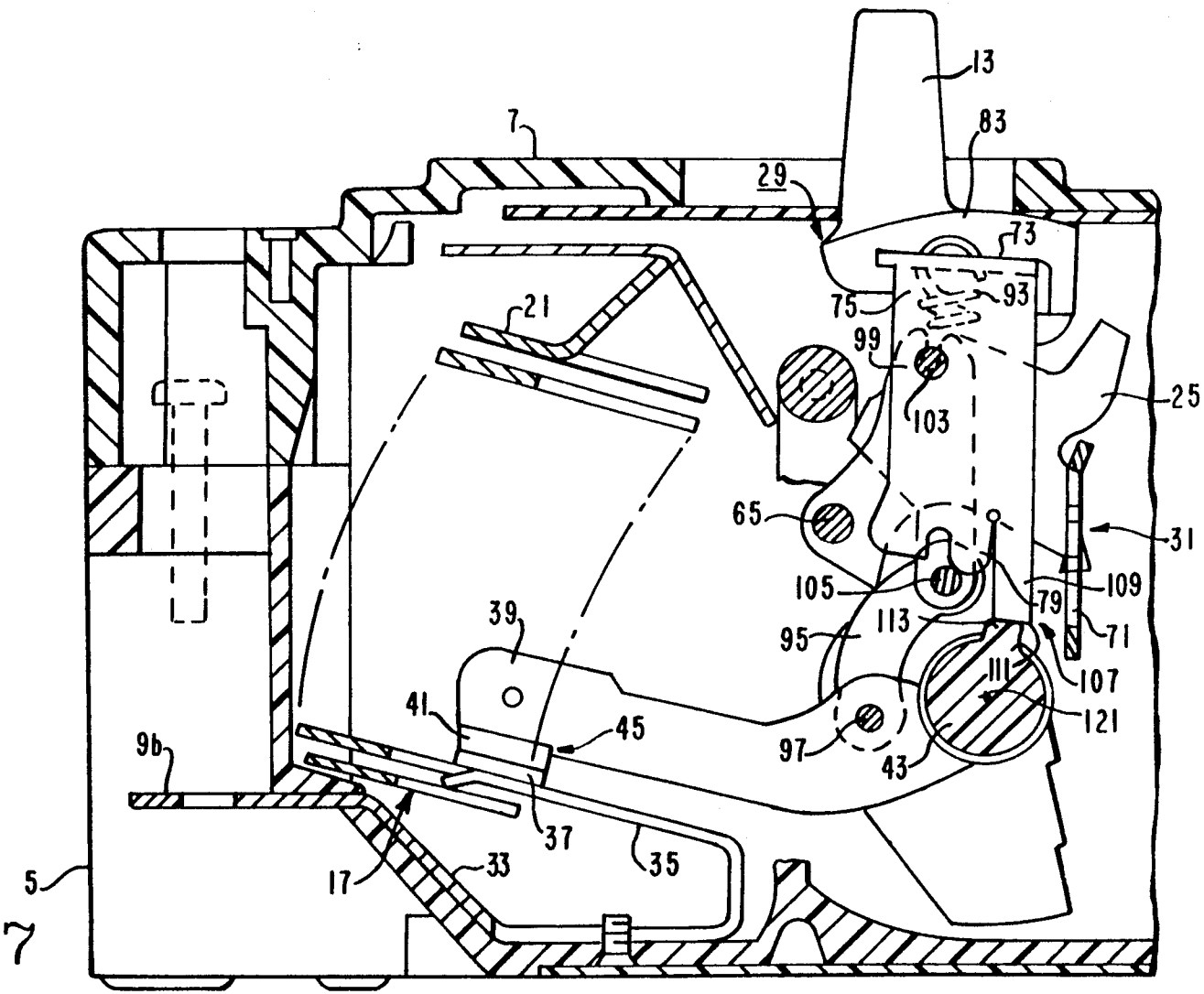
FIG. 7 is a fragmentary view similar to FIG. 2 showing the circuit breaker when an attempt is made to move the handle to the off position with the contacts welded closed.

If an overcurrent condition occurs, and the trip device 31 responds to unlatch the cradle 25, the toggle device 91 operates as previously explained to rotate the contact arms 39 and the cross-bar 43 to the position shown in FIG. 5 wherein the cross-bar has been rotated clockwise out of the way of the extension 109 on the yoke arm 75. If the handle is then moved rearwardly toward the off position to reset the circuit breaker, or the handle is moved manually to the off position to open the circuit breaker, the yoke 73 is free to rotate to the off position since the projections 113 have been rotated out of the way of the extensions 109 on the yoke 73. However, if the contacts are welded closed, as shown in FIG. 7, so that the cross-bar 43 cannot be rotated, and hence the projections 113 remain extending vertically upward, the yoke 73, and therefore the handle, cannot be moved to the off position as the engagement surfaces 111 on the extensions 109 contact the abutment surfaces 119 to block rotation of the yoke 73. The extensions 109 and projections 113 are dimensioned so that the handle can only be rotated about three degrees beyond the over center position. The handle will not remain in this position if unrestrained and will return to the on position to indicate that the contacts 45 remain closed. If one of the sets of contacts 45, other than the contacts of the center pole, are the contacts which are welded closed, the compression springs 51 allow the cross-bar to rotate a few degrees. However, since the abutment surfaces 119 of the projections 113 are arcuate surfaces having a center of curvature centered on the longitudinal axis 121 of the cross-bar, the allowable over-travel of the handle remains at three degrees over center.

This simple but effective means to mechanically block movement of the handle to the off position when the circuit breaker contacts are welded closed, only requires the provision of the extensions on the yoke arms and the projections or inserts extending from the cross-bar.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An electrical circuit breaker, comprising:

a housing;

a fixed contact mounted in said housing;

a movable contact mounted in said housing and closable upon said fixed contact;

a movable contact arm structure including a cross-bar having a recess mounted for rotation about a longitudinal axis and a movable contact arm carrying said movable contact and mounted on said cross-bar for rotation between open and closed positions to open and close said contacts;

a spring powered operating mechanism including a pivoted operating member carrying a handle, said operating mechanism connected to said movable contact arm structure for rotating said movable contact arm structure between an on position of said handle in which said movable contact arm structure is in the closed position to close said contacts and on off position of said handle in which said movable contact arm structure is in the off position to open said contacts;

a trip device responsive to predetermined current overload conditions in the circuit breaker connected to said spring powered operating mechanism for causing said spring powered operating mechanism to rotate said movable contact arm structure to the open position and to place the handle in a trip position between said on and said off positions;

said trip device being reset by moving said handle past said off position; and interlock means comprising a radially extending projection seated in said recess of said cross-bar and extending radially outward therefrom having a generally radially outward facing abutment surface, and a generally radially facing engagement surface on said pivoted operating member, said abutment surface on said radial extending projection being engaged by the engagement surface on said pivoted operating member to prevent movement of said handle to the off position when said movable contact arm structure is prevented from rotating with the contacts welded closed.

2. The circuit breaker of claim 1 wherein said movable contact arm is pivotally mounted on said cross-bar and wherein said movable contact arm structure includes a contact loading spring bearing against the movable contract arm to bias the movable contact against the fixed contact with a predetermined loading force with the contacts closed, the generally radially outward facing abutment surface on said projection extending generally radially outward from said cross-bar and having a radius of curvature centered on the longitudinal axis of said cross-bar.

3. The circuit breaker of claim 2 wherein said operating member is a yoke having two yoke arms spaced apart by a web, said yoke being pivoted for rotation about a transverse axis adjacent free ends of said yoke arms, said generally radially facing engagement surface being provided on at least one of said yoke arms.

4. The circuit breaker of claim 3 wherein said free ends of said yoke arms have arcuate sections about which said yoke rotates about said transverse axis which is offset from the longitudinal axis of said cross-bar, and wherein said at least one yoke arm includes an extension extending beyond said free ends and terminating in said generally radially facing engagement surface which engages said abutment surface on said projection extending from said cross-bar.

5. The circuit breaker of claim 4 wherein both of said yoke arms have extensions extending beyond the free ends of said yoke arms and terminating in a generally radially facing engagement surface, and wherein two projections extend generally radially outward from said cross-bar and each have a generally radially facing abutment surface which is engaged by the generally radially facing engagement surface on one of said extensions.

6. The circuit breaker of claim 5 wherein said cross-bar has two radial recesses and said projections are inserts seated in said recesses and extending generally radially outward.

7. A multiphase electrical circuit breaker, comprising:

a housing;

a fixed contact for each phase mounted in said housing;

a movable contact for each phase mounted in said housing and closable upon said fixed contact for the respective phase;

a movable contact arm for each phase carrying the movable contact for the respective phase;

a common cross-bar having a pair of recesses mounted for rotation about a longitudinal axis and to which each movable contact arm is connected for rotation between open and closed positions to open and close said contacts;

a contact loading spring for each phase attached to said common cross-bar biasing said movable contact arms to apply a predetermined loading to said contacts when closed;

a handle yoke carrying a handle and having a pair of spaced apart yoke arms terminating in arcuate free ends about which said handle yoke is pivoted;

a spring biased toggle device connecting said handle yoke to one of said contact arms for rotating said one contact arm and with it said cross-bar and the other contact arms between and on position on said handle in which said movable contact arms are all in the closed position to close said contacts and an off position of said handle in which all of said movable contact arms are in the open position to open said contacts;

a trip device connected to said spring biased toggle device and responsive to predetermined overcurrent conditions to actuate said spring biased toggle device for causing said spring biased toggle device to rotate said movable contact arm to said open position and to place said handle in a trip position intermediate said on and said off position;

said trip device being reset by moving said handle past said off position; and interlock means comprising extensions on said yoke arms of said handle yoke terminating in generally radial facing engagement surfaces, and a pair of radially extending projections seated in said recesses on said cross-bar and extending radially outward therefrom terminating in radially outward facing abutment surfaces both having a radius of curvature centered on the longitudinal axis of said cross-bar and which are engaged by the engagement surfaces of said extensions on the yoke arms to prevent rotation of said handle to the off position when any of said contacts are welded closed preventing rotation of the cross-bar.

* * * * *